United States Patent [19]

Olson et al.

[11] Patent Number: 4,932,675

[45] Date of Patent: Jun. 12, 1990

[54] SKATE ASSEMBLY

[75] Inventors: Scott B. Olson, 10357 Morgan Ave. South, Bloomington, Minn. 55431; George E. McNamara, Minneapolis, Minn.; Joseph J. Hennessy, St. Louis Park, Minn.

[73] Assignee: Scott B. Olson, Bloomington, Minn.

[21] Appl. No.: 219,504

[22] Filed: Jul. 15, 1988

Related U.S. Application Data

[63] Continuation-in-part of Ser. No. 935,771, Nov. 28, 1986, abandoned.

[51] Int. Cl.[5] ..... A63C 17/18

[52] U.S. Cl. ..... 280/7.13; 280/11.12; 280/11.22; 280/11.27; 280/11.3

[58] Field of Search ..... 280/7.13, 11.12, 11.17, 280/11.18, 11.19, 11.22, 11.27, 11.28, 11.3, 11.34

[56] References Cited

U.S. PATENT DOCUMENTS

| | | | |
|---|---|---|---|
| 908,536 | 1/1909 | Arlund | 280/11.3 |
| 2,706,119 | 4/1955 | Uphoff | 280/11.3 |
| 2,868,553 | 1/1959 | Rieckman | 280/11.27 |
| 3,026,118 | 3/1962 | Paré | 280/11.3 |
| 3,367,669 | 2/1968 | Collins | 280/11.3 |
| 4,008,901 | 2/1977 | Conn | 280/7.13 |
| 4,108,450 | 8/1978 | Cote | 280/7.13 |
| 4,114,295 | 9/1978 | Schaefer | 36/100 |
| 4,218,069 | 8/1980 | Baikie | 280/11.12 |
| 4,351,536 | 9/1982 | Sandino | 280/7.13 |
| 4,492,385 | 1/1985 | Olson | 280/7.13 |
| 4,549,742 | 10/1985 | Husak et al. | 280/11.18 |
| 4,657,265 | 4/1987 | Ruth | 280/7.13 |

FOREIGN PATENT DOCUMENTS

| | | | |
|---|---|---|---|
| 20215 | 11/1882 | Fed. Rep. of Germany | 280/11.30 |

*Primary Examiner*—Charles A. Marmor
*Assistant Examiner*—Brian L. Johnson
*Attorney, Agent, or Firm*—William L. Huebsch

[57] ABSTRACT

A skate assembly having front and rear attachment portions adapted to be incorporated into or attached respectively to the sole and heel of a boot; and an elongate sub-assembly including a molded polymeric frame having a lower portion in which an ice blade or wheel are mounted and spaced front and rear upper portions each having spaced side wall portions projecting from the lower portion. The upper portions can be releasably attached to the attachment portions by engaging longitudinal tongues on one of the portions in grooves in the other, and a fastening system is provided for retaining the portions with the tongues in the grooves in an engaged position.

41 Claims, 5 Drawing Sheets

SKATE ASSEMBLY

RELATED APPLICATION

This is a continuation in part of U.S. patent application No. 935,771 filed Nov. 28, 1986, and now abandoned, the content whereof is incorporated herein by reference.

TECHNICAL FIELD

The present invention relates to skate assemblies having sub assemblies including ice blades or rollers, which sub assemblies are attached to skating boots by attachment means that allow users to easily remove attached sub assemblies from the boots and then re-attach the same or different compatible sub assemblies to the boots.

BACKGROUND

The art is replete with skate assemblies having sub assemblies including ice blades or rollers, which sub assemblies are attached to skating boots by attachment means that allow users to easily remove attached sub assemblies from the boots and then re-attach the same or different compatible sub assemblies to the boots. U.S. Pat. Nos. 908.536, 2,706,119, 2,868,553, 3,026,118, 3,367,669, 4,008,901, 4,492,385 and 4,657,265 provide illustrative examples.

While this concept has been around for many years, and provides many potential advantages such as the ability to have a second pair of sub assemblies with ice blades that could be sharpened and ready for use when ice blades in sub assemblies being used on the boots become dull, or to change between sub assemblies with ice blades and sub assemblies with wheels when skating on different surfaces if desired, at present there is no known commerically successful skate assembly that embodies that concept. Presumably this is so because the sub assembly structures heretofore known for such purposes and the means by which they were releasably attached did not provide a sufficiently light conventionally shaped skate assembly with sufficiently firm attachment to prevent relative movement between the sub assembly and the boot particularly during prolonged hard use of the skate assembly (which lack of relative movement would be required by the serious skater before he would accept such a skate assembly), while still providing relatively easy disengagement of the sub assembly from the boot.

DISCLOSURE OF INVENTION

The present invention provides a skate assembly including a sub assembly that may include a blade or rollers and can be attached to a boot by attachment means that allow the sub assembly to be relatively easily removed from the boot by the user to afford changing sub assemblies and thereby, for example, changing a sharp blade for a dull blade, interchanging blades between left and right boots to change dull inner edges for sharper outer edges, or to change blades for rollers if it is desired to skate over a different surface; which assembly is light, can have a conventional appearing structure, and includes mean for releasably attaching the sub assembly to a boot that effectively prevents relative movement between the sub assembly and the boot, including during prolonged hard use of the skate assembly such as by a serious skater playing hockey in the amateur or professional leagues.

According to the present invention there is provided a skate assembly comprising front and rear attachment portions adapted to be incorporated in or attached respectively to the sole and heel of a boot. The skate assembly also includes an elongate sub-assembly including a molded polymeric frame having a lower portion in which is mounted means (e.g., an ice blade or in line rollers) projecting past a bottom surface of the lower portion for affording rapid movement of the skate assembly along a substrate (e.g., an ice sheet or paved surface respectively), and spaced front and rear upper portions each having opposite spaced side wall portions projecting away from the lower portion. Means are provided for releasably engaging the rear upper portion to the rear attachment portion and the front upper portion to the front attachment portion. For each pair of portions to be engaged, one of the portions has surfaces defining a pair of grooves extending along its side surfaces from inlets adjacent one of its ends toward the other of its ends; and the other of the portions has a pair of tongues extending from one of its ends toward the other of its ends, with each tongue projecting from a different one of its side surfaces and adapted to enter a different one of the grooves from the inlet to an engaged position with the surfaces of the tongues in frictional engagement with the surfaces defining the grooves; and fastening means are provided to releasably retain the portions with the tongues in the grooves in the engaged position.

For each pair of portions to be engaged, the attachment portion can provide the tongues and recesses along the upper surfaces of the tongues; and the upper portion of the frame can have ridges defining the upper surfaces of the grooves that are positioned in the recesses when the pair of portions are engaged. The tongues can project in opposite directions generally parallel to an upper surface of the attachment portion and the grooves are recessed from the inner surfaces of the side walls forming the upper portions of the frame. Alternately the tongues can be opposed and project toward each other generally parallel to that upper surface, and the grooves can be recessed from the outer surfaces of the side walls forming the upper portions of the frame. In either case, the tongues can enter the grooves from inlets either at the front or the rear of the upper portion of the frame, with entry from inlets at the front being preferred so that impacts against the front of the frame during skating will not tend to dislodge the tongues from the grooves.

To assure firm engagement between the attachment and upper portions that restricts relative movement therebetween during skating, the opposite inner surfaces and/or the upper and lower surfaces that define the grooves can be tapered from the inlets to the grooves and the tongues can have surfaces correspondingly tapered and adapted to fully engage the inner and/or upper and lower surfaces defining the grooves when the tongues are fully engaged in the grooves. Additionally, the opposite upper and lower surfaces partially defining the grooves and along the tongues can be disposed to form dovetail transverse cross sections for the grooves and tongues to thereby further restrict relative movement therebetween, including any tendency for the tongues to move transversally out of the grooves.

The fastening means can comprise, for one pair of portions to be engaged, a first fastening member attached to one of the portions and a second fastening member engaging the other of the portions and adapted to releasably engage the first fastening member. When the inlets to the grooves are adjacent the rear ends of the upper portions, the first fastening member can be attached to the rear upper portion adjacent its front end and extend longitudinally of the sub-assembly toward the rear end of the rear upper portion, the rear attachment portion can have a part projecting along the rear end of the rear upper portion when the tongues are engaged in the grooves., and the second fastener member can be positioned within the projecting part at which position it may easily be manipulated through the rear end of the rear attachment member (e.g., with some type of wrench) to releasably engage the second fastener member (which may be an internally threaded nut) with the first fastener member (which may have a threaded end portion for engagement by the nut). Alternatively, when the inlets to the grooves are adjacent the front ends of the upper portions, the rear attachment member can have a projecting part projecting along the front end of the rear upper portion when the tongues are engaged in the grooves, the first fastening member (e.g., an internally threaded insert) can be attached to the projecting part, and the second fastening member !e.g., an allen head bolt) can engage the rear upper portion adjacent the rear end of the rear upper portion at which position it may be manipulated by some type of wrench, and extend longitudinally of the sub-assembly toward the front end of the rear upper portion to engage to releasably (e.g., threadably) engage the first fastening member. In either structure the projecting parts can be received in a socket in the rear upper portion when the tongues are fully received in the grooves to retain a smooth conventional contoured shape for the rear upper portion.

The shape of the attaching portions used on right and let boots are preferably the same so that the sub assemblies can be interchanged between left and right boots to, for example, change dull inner edges on ice blades (which typically become dull more quickly during skating) for sharper outer edges, to thereby improve skating performance without again sharpening the blades and thereby increase the usable life of the blades.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
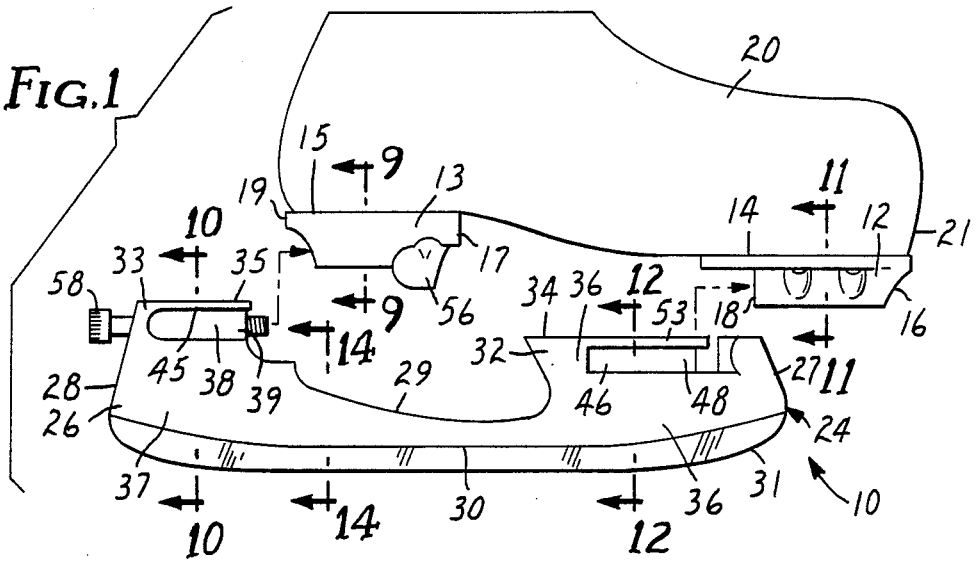
FIGS. 1, 2, and 3 are side views of a first embodiment of a skate assembly according to the present invention illustrated with attachment portions of the skate assembly attached to a boot and sequentially illustrating movement of a sub-assembly of the skate assembly from a disengaged to an engaged position with resepect to the attachment portions.
Figure 2:
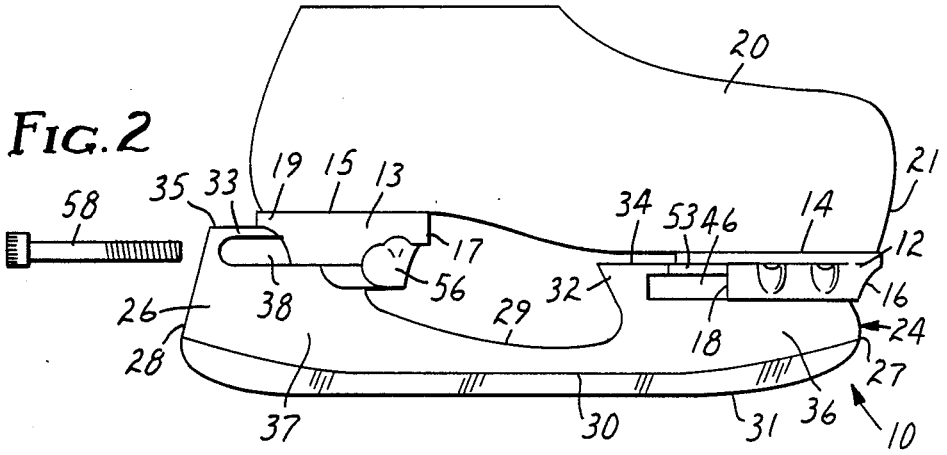
Figure 3:
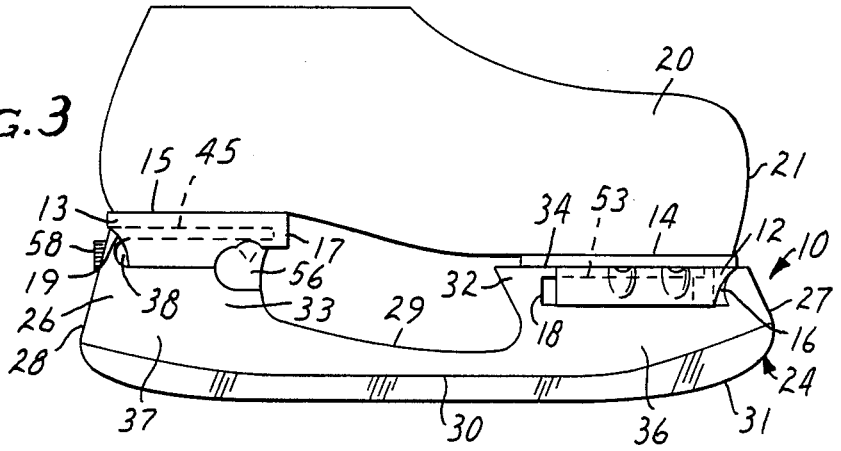
Figure 4:
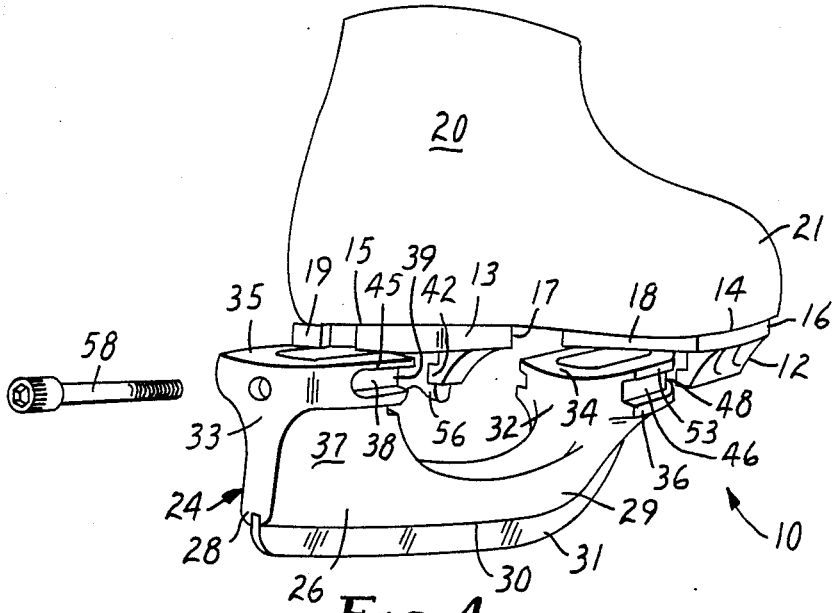
FIG. 4 is a perspective view of the skate assembly and boot illustrated in FIG. 1 with the portions and sub-assembly in the disengaged position.

Referring now to the drawing, there is shown in FIGS. 1-15 a first embodiment of a skate assembly according to the present invention generally designated by the reference numeral 10.

The skate assembly 10 is a hockey type skated assembly and comprises front and rear attachment portions 12 and 13 having generally planar upper or top surfaces 14 and 15, front ends 16 and 17, rear ends 18 and 19, and opposite side surfaces extending between the front and rear ends 16 and 18 or 17 and 19. The front and rear attachment portions 12 and 13 are adapted to be attached respectively to the sole and heel of a boot 20 as illustrated with their upper surfaces 14 and 15 against the bottom surfaces on the sole and heel and the front ends 16 and 17 of the attachment portions 12 and 13 adjacent a front end 21 of the boot 20. The skate assembly also includes an elongate sub-assembly 24 including a molded polymeric (e.g., nylon or urethane) frame 26 having a front end 27, a rear end 28, a lower portion 29 having a bottom surface 30 from which downwardly projects means in the form of an ice blade 31 for affording rapid movement of the skate assembly 10 along a substrate such as a sheet of ice, and spaced front and rear upper portions 32 and 33. Each of the upper portions 32 and 33 includes a wall with an outer surface and an inner surface defining a central cavity opening through its upper or uppermost surface 34 or 35, which wall has opposite spaced side wall portions 36 or 37, projects upwardly away from the lower portion 29, and has front ends adjacent the front end 27 of the frame 26 and rear ends adjacent the rear end 28 of the frame 26.

Attachment means are provided for releasably engaging the rear upper portion 33 of the frame 26 to the rear attachment portion 13 and the front upper portion 32 of the frame 26 to the front attachment portion 12. The spaced side wall portions 37 of the rear upper portion 33 of the frame 26 have opposite grooves 38 along their outer surfaces, which grooves 38 are defined by opposite upper and lower surfaces and innermost or recessed surfaces and extend generally parallel to its upper surface 35 from an inlet 39 adjacent its front end toward its rear end; and the rear attachment portion 13 has a pair of opposed inwardly projecting tongues 42 having opposite upper and lower surfaces and opposed innermost or distal surfaces extending from the rear end toward the front end of the rear attachment portion 13 into a central opening in the rear attachment portion 13. From a disengaged position of the attachment portions 12 and 13 and upper portions 32 and 33 (FIGS. 1 and 4) the tongues 42 are adapted to enter different ones of the grooves 38 endwise from their inlets 39 and now generally parallel to the upper surfaces 34 and 35 of the upper portions 32 and 33 to an engaged position (FIGS. 3 and 8) with the surfaces on the tongues 42 and the surfaces defining the grooves 38 in close surface to surface engagement. The rear attachment portion 13 has recesses 44 along the upper surfaces of the tongues 42; and the rear upper portion 33 of the frame 26 has ridges 45 defining the upper surfaces of the grooves 38, which ridges 45 are positioned in the recesses 44 when the rear attachment portion 13 and the rear upper portion 33 of the frame 26 are engaged. Similarly, the spaced side wall portions 36 of the front upper portion 32 of the frame 26 have opposite grooves 46 along their outer surfaces, which grooves 46 are defined by opposite upper and lower surfaces and innermost surfaces, extend generally parallel to the upper surface 14 of the front upper portion 32 from an inlet 48 adjacent its front end toward its rear end; and the front attachment portion 12 has a pair of opposed inwardly projecting tongues 49 having upper and lower surfaces and opposed innermost surfaces extending from the rear end toward the front end of the front attachment portion 12 into a central opening in the front attachment portion 12 so that from the disengaged position of the attachment portions 12 and 13 and upper portions 32 and 33 (FIGS. 1 and 4) the tongues 49 are adapted to enter a different one of the grooves 46 from their inlets 48 and move generally parallel to the upper surfaces 14 and 15 of the upper portions 32 and 33 to an engaged position (FIGS. 3 and 8) with the surfaces on the tongues 49 and the surfaces defining the grooves in close surface to surface engagement. The front attachment portion 12 has recesses 52 along the upper surfaces of the tongues 49; and the front upper portion 32 of the frame 26 has ridges 53 defining the upper surfaces of the grooves 46, which ridges 53 are positioned in the recesses 52 when the front attachment portion 12 and the front upper portion 32 of the frame 26 are engaged.

Figure 5:
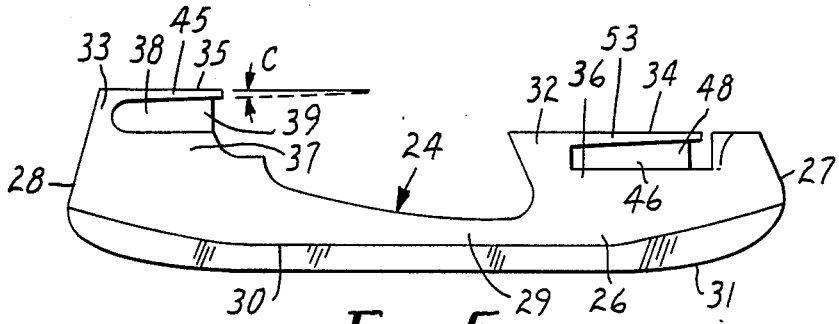
FIG. 5 is a side view of the sub-assembly illustrated in FIG. 1.
Figure 6:
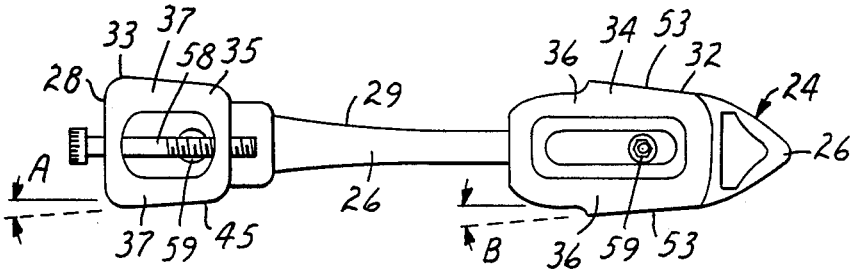
FIG. 6 is a top view of the sub-assembly illustrated in FIG. 1.

To assure engagement between the attachment portions 12 and 13 and upper portions 32 and 33 that is sufficiently firm to restrict relative movement therebetween during skating, the opposite inner surfaces that define the grooves 38 and 46 (and are generally at right angles to the upper surfaces 34 and 35 of the upper portions 32 and 33 of the frame 26) are tapered outwardly from the inlets 39 and 48 to the grooves 38 and 46, and the opposed innermost surfaces of the tongues 42 and 49 are correspondingly tapered outwardly away from the front ends 16 and 17 of the attachment portions 12 and 13 at the same angle so that they will fully and frictionally engage the inner surfaces defining the grooves 38 and 46 when the tongues 42 and 49 are fully engaged in the grooves 38 and 46. Optionally, the upper surfaces defining the grooves 38 and 46 can be parallel to the upper surfaces 34 and 35 or can be tapered by a slight angle c as illustrated in FIG. 5 with respect to the upper surfaces 34 and 35 of the upper portions 32 and 33 and the upper surfaces of the tongues can be correspondingly tapered so that when the tongues 42 and 49 are fully engaged in the grooves 38 and 46 the upper surfaces of the tongues 42 and 49 will also frictionally engage the upper surfaces defining the grooves 38 and 46 that are along the ridges 45 and 53 at right angles to the inner surfaces of the grooves 38 and 46. If even further frictional engagement is desired, the outer surfaces of the ridges 45 and 53 may also be tapered away from the inlet ends of the grooves 38 and 46 (such as at angles A and B with respect to the longitudinale center line of the sub assembly 24 as illustrated in FIG. 6), and the inner surfaces of the recesses may be correspondingly tapered so that they will fully and frictionally engage the outer surfaces of the ridges 45 and 53 when the tongues 42 and 49 are fully engaged in the grooves 38 and 46.

Fastening means are provided to releasably retain the attachment portions 12 and 13 and the upper portions 32 and 33 in the engaged position. The rear attachment portion 13 has a projecting part 56 projecting along the front end of the rear upper portion 33 when the tongues 42 and 49 are engaged in the grooves 38 and 46. A first fastening member or internally threaded insert 57 is attached to the projecting part 56, and a second fastening member or allen headed bolt 58 extends through openings in the rear upper portion 33 longitudinally of the sub-assembly 24 toward the front end of the rear upper portion 33 and had a threaded end portion adapted to releasably engage the threaded insert 57. A wall near the end of the rear upper portion 33 that defines one of the openings in which the bolt 58 is received including a socket portion that partially receives the head of the bolt 58 restricts movement of the head toward the front end of the rear upper portion 33 so that rotation of the bolt 58 using a tool or allen wrench engaged with its head will cause the threded end of the bolt 58 to engage the threaded insert 57 and draw the projecting part 56 into a correspondingly shaped socket along the front end of the rear upper portion 33 (which engagement is along surfaces transverse to the sub assembly 24 including engagement of a ledge 55 in a recess (FIG. 8) and further restricts relative movement between the rear upper portion 33 and the rear attachment portion 13) and the tonguue 42 and 49 into full surface to surface frictional engagement with the grooves 38 and 46. The tightened bolt 58 will then hold the tongues 42 and 49 and grooves 38 and 46 in such engagement while the skate assembly is used, but can be subsequently released by reverse rotation of the bolt to allow separation of the sub assembly 24 from the attachment portions 12 and 13, which separation will typically require a sharp blow to the sub assembly 24 to release the frictional engagement between the tongues 42 and 49 and the surfaces defining the grooves 38 and 46.

Figure 8:
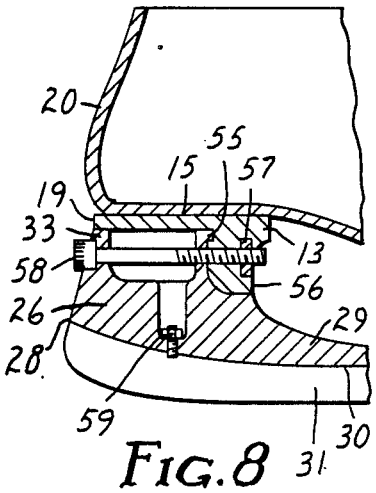
FIG. 8 is a fragmentary vertical section view of the skate assembly and boot illustrated in FIG. 1 with the attachment portions and sub-assembly in the engaged position illustrated in FIG. 3.
Figure 9:
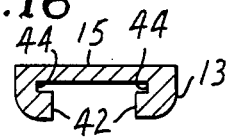
FIGS. 9, 10, 11, and 12 are sectional views taken approximately along lines 9—9, 10—10, 11—11, and 12—12 of FIG. 1 respectively.
Figure 11:
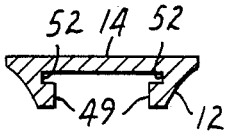
Figure 10:
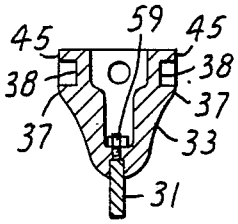
Figure 12:
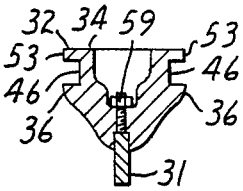
Figure 13:
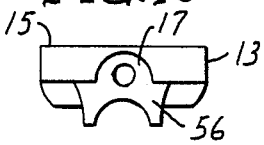
FIG. 13 is a vertical front end view of a rear attachment portion included in the skate assembly illustrate in FIG. 1.
Figure 15:
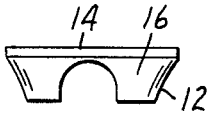
FIG. 15 is a vertical front end view of front attachment portion included in the skate assembly illustrated in FIG. 1.
Figure 14:
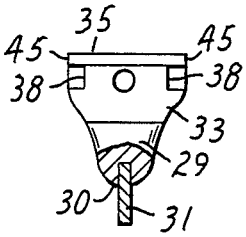
FIG. 14 is a sectional view taken approximately along line 14—14 of FIG. 1.
Figure 7:
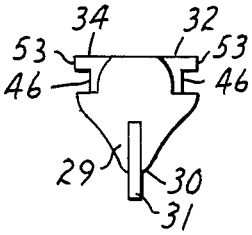
FIG. 7 is a vertical front end view of the sub-assembly of the skate assembly illustrated in FIG. 1.
Figure 17:
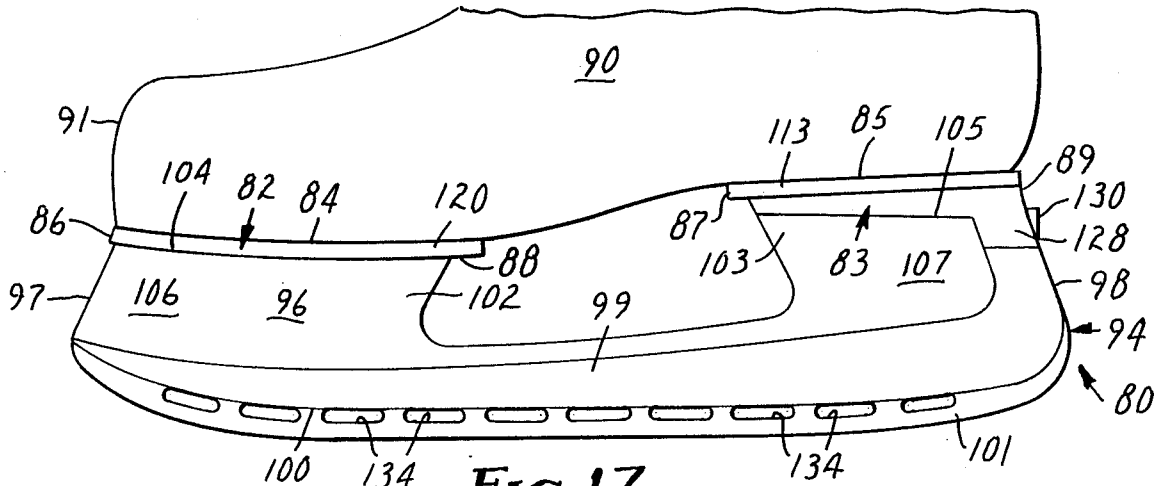
FIG. 17 is a side view of a third embodiment of a skate assembly according to the present invention shown attached to a boot.

As can best be seen in FIGS. 8, 10, and 12, the blade 31 is mounted in the frame 26 by having an upper portion of the blade 31 received in a close fitting groove opening through its bottom surface 30, and is held in the groove by upwardly projectly bolts with nuts 59 at their upper ends in and accessible through the cavaties in the upper portions 32 and 33 of the frame 26.

Figure 16:
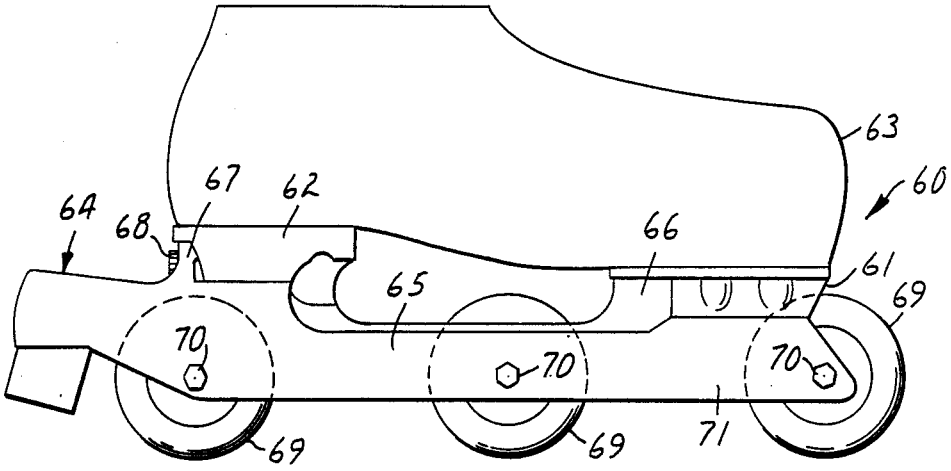
FIG. 16 is a side view of a second embodiment of a skate assembly according to the present invention.

Referring now to FIG. 16 there is shown a second embodiment of a skate assembly 60 according to the present invention which include front and rear attachment portions 61 and 62 attached to a boot 63 and a sub assembly 64 including a frame 65 having front and rear upper portions 66 and 67 that releasably engage the attachment portions 61 and 62 in the same manner that the upper portions 32 and 33 of the frame 26 engage the attachment portions 12 and 13 in the skate assembly 10 described above, and which portions 61, 62, 66 and 67 are also held in their engaged position by similar attaching means including a bolt 68. The skate assembly 60 primarily differs from the skate assembly 10 in that the means for affording rapid movement of the skate assembly 60 along a substrate is a plurality of aligned wheels 69 rotatably mounted by parallel transverse axle bolts 70 between spaced longitudinal parts of a lower portion 71 of the frame 65 with portions of the wheels 69 projecting from its lower surface to afford movement of the skate assembly 64 along a substrate such as a paved street.

Referring now to the drawing, there is shown in FIGS. 17 through 28 a third embodiment of a skate assembly according to the present invention generally designated by the reference numeral 80.

The skate assembly 80 is a hockey type skate assembly comprising front and rear attachment portions 82 and 83 having respectively generally planar upper or top surfaces 84 and 85, front ends 86 and 87, rear ends 88 and 89, and opposite side surfaces extending between the front and rear ends 86 and 88 or 87 and 89. The front and rear attachment portions 82 and 83 as illustrated are adapted to be attached respectively to the sole and heel of a boot 90 by rivets through holes 92 around their peripheries with their upper surfaces 84 and 85 against the bottom surfaces on the sole and heel and the front ends 86 and 87 of the attachment portions 82 and 83 adjacent a front end 91 of the boot 90. The skate assembly also includes an elongate sub-assembly 94 including a molded polymeric (e.g., nylon or urethane) frame 96 having a front end 97, a rear end 98, a lower portion 99 having a bottom surface 100 from which downwardly projects means in the form of an ice blade 101 for affording rapid movement of the skate assembly 80 along a substrate such as a sheet of ice, and spaced front and rear upper portions 102 and 103. Each of the upper portions 102 and 103 includes a wall with an outer surface and an inner surface defining a central cavity opening through its upper or uppermost surface 104 or 105, which wall has spaced side wall portions 106 or 107, projects and diverges upwardly from the lower portion 96, and has front ends adjacent the front end 97 of the frame 96 and rear ends adjacent the rear end 98 of the frame 96.

Attachment means are included in the skate assembly 80 for releasably engaging the rear upper portion 103 of the frame 96 to the rear attachment portion 83 and the front upper portion 102 of the frame 96 to the front attachment portion 82. The rear upper portion 103 of the frame 96 has a pair of opposed grooves 108 along the inner surfaces of its spaced side wall portions 107, each defined by opposite upper and lower surfaces and innermost or recessed surfaces, which grooves 108 extend generally parallel to its upper surface 105 from an inlet 109 adjacent its rear end toward its front end; and the rear attachment portion 83 has a pair of opposite outwardly projecting tongues 112 having opposite upper and lower surfaces and outermost or distal surfaces extending from the front end toward the rear end of the rear attachment portion 83. From a disengaged position of the attachment portions 82 and 83 and upper portions 102 and 103 (FIG. 18) the tongues 112 are adapted to enter different ones of the grooves 108 endwise from their inlets 109 and move generally parallel to the upper surfaces 104 and 105 of the upper portions 102 and 103 to an engaged position (FIG. 17) with the surfaces on the tongues 112 and the surfaces defining the grooves 108 in close surface to surface engagement. The rear attachment portion 83 comprises a top plate part having the upper surface 85, an opposite lower surface, and a peripheral edge surface 113 between the upper and lower surfaces extending beyond all portions of the tongues 112, and has recesses 114 along the upper surfaces of the tongues 112; and the rear upper portion 103 of the frame 96 has ridges 115 defining the upper surfaces of the grooves 108, which ridges 115 are positioned in the recesses 114 when the rear attachment portion 83 and rear upper portion 103 of the frame 96 are engaged. Similarly, the front upper portion 102 of the frame 96 has a pair of opposed grooves 116 along the inner surfaces of the spaced side wall portions 106 each defined by opposite upper and lower surfaces and innermost surfaces, which grooves 116 extend generally parallel to its upper surface 104 from an inlet 118 adjacent its rear end toward its front end; and the front attachment portion 82 has a pair of opposite outwardly projecting tongues 119 having opposite upper and lower surfaces and outmost surfaces extending from the front end 86 toward the rear end 88 of the front attachment portion 82. From the disengaged position of the attachment portions 82 and 83 and upper portions 102 and 103 (FIG. 18) the tongues 119 are adapted to enter a different one of the grooves 116 from their inlets 118 and move generally parallel to the upper surfaces 104 and 105 of the upper portions 102 and 103 to an engaged position (FIG. 17) at which the surfaces on the tongues 119 and the surfaces defining the grooves 116 are in surface to surface engagement. Thr front attachment portion 82 comprises a top plate part having the upper surface 84, an opposite lower surface, and a pheripheral edge surface 120 between the upper and lower surfaces extending beyond all portions of the tongues 119, and the attachment portion has recesses 122 along the upper surfaces of the tongues 119; and the front upper portion 102 of the frame 96 has ridges 123 defining the upper surfaces of the grooves 116, which ridges 123 are positioned in the recesses 122 when the front attachment portion 82 and the front upper portion 102 of the frame 96 are engaged.

The opposite upper and lower surfaces defining the grooves 108 and 116 are tapered toward each other from the inlets 109 and 118 at a slight angle (e.g., 1 degree for each surface) and the tongues 112 and 119 have surfaces similarly tapered and adapted to fully engage the upper and lower surfaces when the tongues 112 and 119 are fully engaged in the grooves 108 and 116. Also, the opposite upper and lower surfaces defining the grooves 108 and 116 and on the tongues 112 and 119 are disposed to form dovetail transverse cross sections for the grooves 108 and 116 and the tongues 112 and 119.

Fastening means are provided to releasably retain the attachment portions 82 and 83 and the upper portions 102 and 103 in the engaged position. A square head 125 on one end of a first fastening member or bolt 126 is attached to the rear upper portion 103 adjacent its front end with the bolt 126 extending longitudinally of the sub-assembly 94 toward the rear end of the rear upper portion 103, and the bolt 126 has a threaded end portion opposite its head 125. The rear attachment portion 83 has a projecting part 128 projecting along the rear end of the rear upper portion 103 when the tongues 112, 115 are in the in the grooves 108 and 116. A second fastener member or internally threaded nut 130 is rotatably mounted in a socket in the projecting part 128 when the sub-assembly 94 is engaged with the attachment portions 82 and 83 the projecting end of the bolt 126 will be received in a longitudinal bore 131 between the tongues 112 in the rear attachment portion 83 aligned with the nut 130 and rotation of the nut 130 using a tool or spanner wrench engaged with it will cause the nut 130 to engage the threaded end of the bolt 126 and draw the sub assembly 94 toward it until the projecting part 128 is positioned in a correspondly shaped socket along the rear end of the rear upper portion 103 (which engagement is along surfaces transverse to the sub assembly 94 and further restricts relative movement between the rear upper portion 103 and the rear attachment portion 83) and the tongues 112 and 119 are in full surface to surface frictional engagement with the grooves 108 and 116. The tightened nut 130 will then hold the tongues 112 and 119 and grooves 108 and 116 in such engagement while the skate assembly is used, but can be subsequently released by reverse rotation of the nut 130 bolt to allow separation of the sub assembly 94 from the attachment portions 82 and 83, which separation will typically require a sharp blow to the sub assembly 94 to release the frictional engagement between the tongues 112 and 119 and the surfaces defining the grooves 108 and 116.

Figure 18:
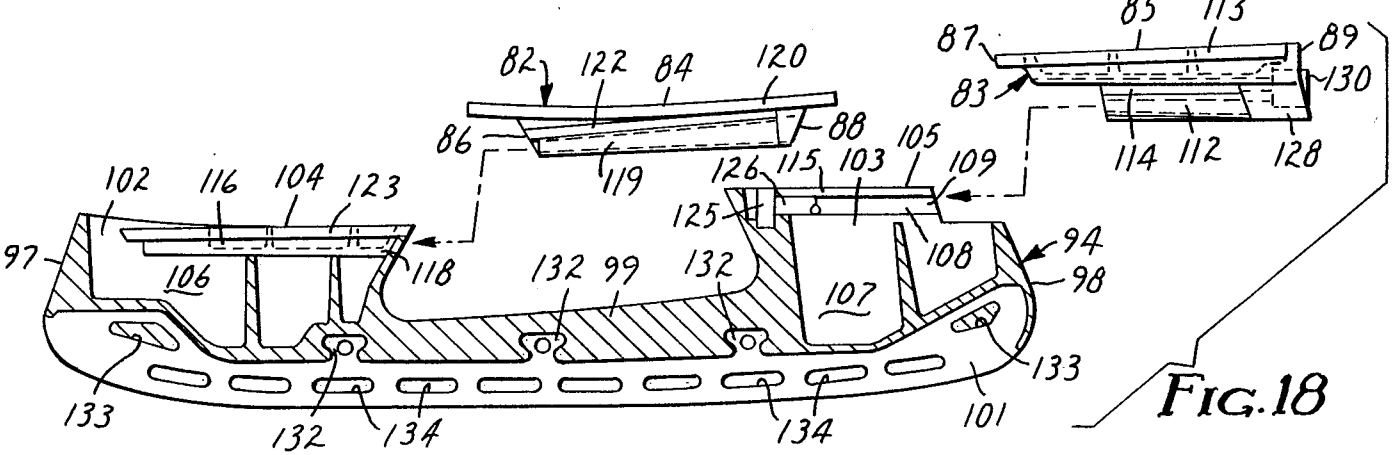
FIG. 18 is vertical sectional view of a sub assembly included in the skate assembly of FIG. 1 together with vertical side views of front and rear attachment portions of that skate assembly separated from the sub assembly.
Figure 19:
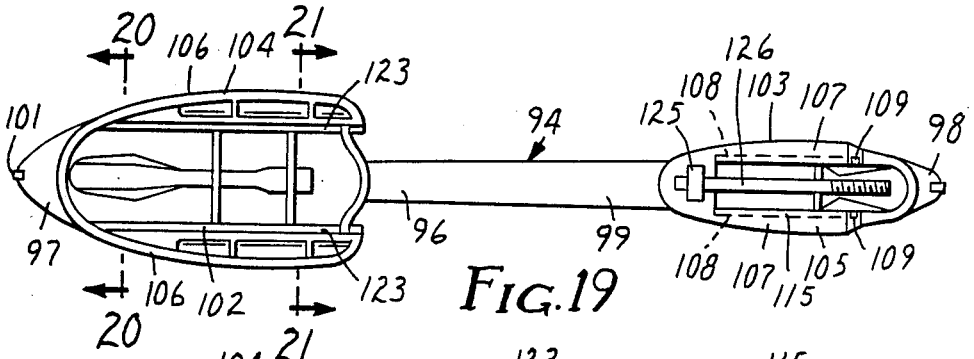
FIG. 19 is a top view of the sub assembly in the skate assembly of FIG. 16.
Figure 20:
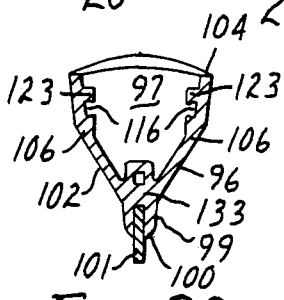
FIG. 20 is a sectional view taken approximately along line 20—20 of FIG. 19.
Figure 21:
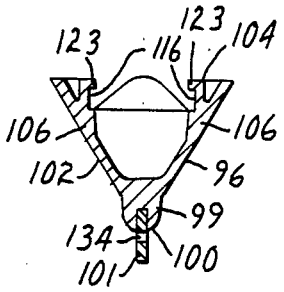
FIG. 21 is a sectional view taken approximately along line 21—21 of FIG. 19.
Figure 22:
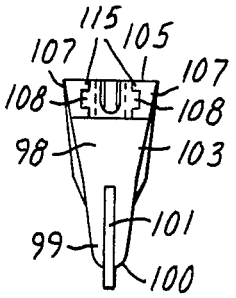
FIG. 22 is a rear end view of the sub assembly as illustrated in FIG. 19.
Figure 23:
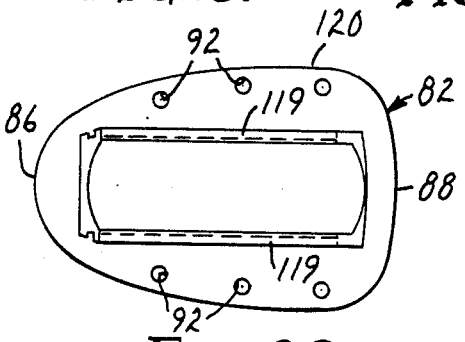
FIG. 23 is a bottom view of the front attachment portion shown separated in FIG. 18.
Figure 26:
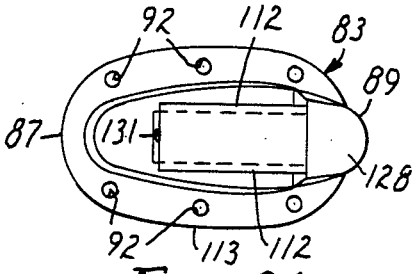
FIG. 26 is a bottom view of the rear attachment portion shown separated in FIG. 18.
Figure 24:
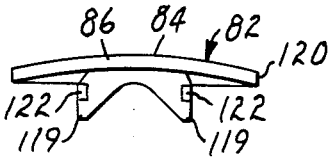
FIG. 24 is a front view of the front attachment portion shown separated in FIG. 18.
Figure 27:
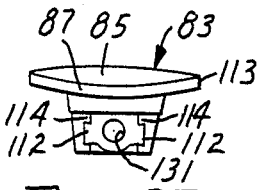
FIG. 27 is a front view of the rear attachment portion shown separated in FIG. 18.
Figure 28:
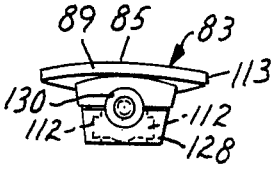
FIG. 28 is a rear view of the rear attachment portion shown separated in FIG. 18.
Figure 25:
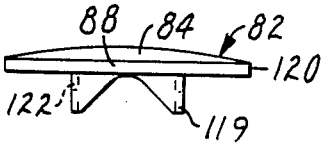
FIG. 25 is a rear view of the front attachment portion shown separated in FIG. 18.

As can best be seen in FIG. 18, the blade 101 has an upper longitudinal portion with spaced upwardly projecting and diverging tabs 132 with through transverse openings and has generally triangular through transverse openings 133 in upwardly projecting portions adjacent its ends. The lower portion 99 of the frame 96 is molded around the upper longitudinal portion of the blade 101 and extends around and through the openings in the tabs 132 and through the triangular openings 133 to help hold the blade 101 in place. The blade 101 also has a series of evenly spaced, longitudinal through transverse openings 134 along the bottom surface 100 of the frame 96 which both lighten the blade 101 and are decorative.

Figure 29:
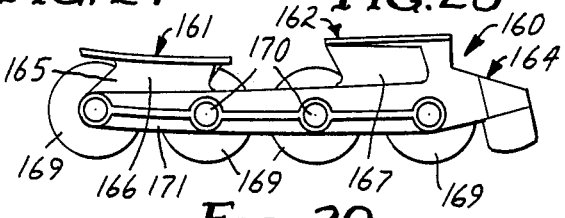
FIG. 29 is a side view of a forth embodiment of a skate assembly according to the present invention.

Referring now to FIG. 29 there is shown a forth embodiment of a skate assembly 160 according to the present invention which includes front and rear attachment portions 161 and 162 adapted to be attached to a boot and a sub assembly 164 including a frame 165 having front and rear upper portions 166 and 167 that releasably engage the attachment portions 161 and 162 in the same manner that the upper portions 102 and 103 of the frame 96 engage the attachment portions 82 and 83 in the skate assembly 80 described above, and which portions 161, 162, 166 and 167 are also held in their engaged position by similar attaching means. The skate assembly 160 primarily differs from the skate assembly 80 in that the means for affording rapid movement of the skate assembly 160 along a substrate is a plurality of aligned wheels 169 rotatably mounted by parallel transverse axles 170 between spaced longitudinally extrending parts of a lower portion 171 of the frame 165 with portions of the wheels 169 projecting from its lower surface to afford movement of the skate assembly 160 along a substrate such as a paved street.

The present invention has now been described with reference to four embodiments thereof. It will be apparent to those skilled in the art that many changes can be made in the embodiments described without departing from the scope of the present invention. For example, the front and attachment portions could be molded as portions of the soles and heels of skating boots, thereby avoiding the necessity to rivet them in place. Various other attachment means could be used to releasably retain the attachment portions and the upper portions in the engaged position, and such attachment means could be between the front upper portion and front attachment portion. Thus the scope of the present invention should not be limited to the structure described in this application, but only by structure described by the language of the claims and the equivalents of those structures.

We claim:

1. A skate assembly comprising:

front and rear attachment portions having generally planar top surfaces, front and rear ends, and opposite side surfaces extending between said front and rear ends, said attachment portions being adapted to be attached respectively to the sole and heel of a boot with said top surfaces against the bottom surfaces on the sole and heel and the front ends of the attachment portions adjacent the front end of the boot;

an elongate sub-assembly including a molded polymeric frame having a front end and a rear end, said frame including a lower portion comprising transversely spaced elongate parts extending between said front and rear ends and having edge surfaces defining a bottom surface for said frame, and said frame further including spaced front and rear upper portions each having an uppermost surface opposite said bottom surface, opposite spaced side wall portions projecting from said lower portion each having inner and outer side surfaces, and front and rear ends, said side wall portions of said front upper portion diverging outwardly from said lower portion toward said uppermost surface of said front upper portion; and an ice blade indcluding a portion mounted between said elongate parts of said lower portion and a portion projecting past said bottom surface for affording rapid movement of said skate assembly along a generally planar ice surface;

means for releasably engaging said rear upper portion to said rear attachmment portion and said front upper portion to said front attachment portion comprising, for each pair of portions to engaged said upper portion having opposite upper and lower surfaces and recessed surfaces defining a pair of grooves extending from an inlet adjacent one of the ends of the upper portion toward the other of the ends of the upper portion, each groove extending along a different one of the side surfaces of said upper portion, and said upper portion including ridges defining the upper surfaces of said grooves and spacing said grooves along said side wall portions from the uppermost surface of said upper portion; and said attachment portion having at least one part adapted to extend along said side surfaces of said side wall portions and including a pair of tongues having opposite upper and lower surfaces and distal surfaces extending from one of the ends of the attachment portion toward the other of the ends of the attachment portion, each tongue adapted to enter a different one of said grooves from said inlet to an engaged position with said surfaces of said grooves and tongues in frictional engagement; and fastening means comprising, for one pair of portions to be engaged, a first fastening member attached to one of said portions and a second fastening member engaging the other of said portions and adapted to releasably engage said first fastening member to releasably retain said portions with said tongues in said grooves in said engaged position.

2. A skate assembly according to claim 1, wherein each of said attachment portions comprises a top plate part having said top surface, an opposite lower surface, and a peripheral edge surface between said top and lower surfaces, said tongues project in opposite directions generally parallel to and spaced from said lower surface of said top plate part, said lower surface of said top plate part extends beyond all portions of said tongues, and said grooves are along the inner surfaces of said spaced side wall portions.

3. A skate assembly according to claim 1 wherein said opposite upper and lower surfaces defining said grooves are tapered toward each other from said inlet and said upper and lower surfaces of said tongues are tapered and are adapted to fully engage said upper and lower surfaces defining the grooves when said tongues are fully engaged in said grooves.

4. A skate assembly according to claim 1 wherein the opposite upper and lower surfaces defining said grooves and the opposite upper and lower surfaces defining said tongues are disposed to form dovetail transverse cross sections for said grooves and said tongues.

5. A skate assembly according to claim 1 wherein said attachment portions each have two spaced parts adapted to extend along the side surfaces of said side wall portions and said tongues are opposed and project toward each other from said two spaced parts generally parallel to said top surface of the attachment portion, and said grooves are along the outer surfaces of said spaced side wall portions.

6. A skate assembly according to claim 5 wherein said recessed surfaces defining said grooves are tapered away from each other from said inlet and said distal surfaces of said tongues are tapered and are adapted to fully and frictionally engage said recessed surfaces defining the grooves when said tongues are fully engaged in said grooves.

7. A skate assembly according to claim 1 wherein the inlets to said grooves are adjacent the rear ends of said upper portions, said first fastening member is attached to said rear upper portion adjacent the front end of said rear upper portion and extends longitudinally of said sub-assembly toward the rear end of said rear upper portion, said rear attachment portion has a projecting part projecting along the rear end of said rear upper portion when said tongues are in said grooves, said projecting part being received in a socket in said rear upper portion when said tongues are fully engaged in said grooves, and said second fastener member is positioned within said projecting part.

8. A skate assembly according to claim 7 wherein said first fastening member has a threaded end portion opposite the front end of said rear upper portion, and said second fastener member is an internally threaded nut rotatably mounted in said projecting part.

9. A skate assembly according to claim 1 wherein the inlets to said grooves are adjacent the front ends of said upper portions, said rear attachment member has a projecting part projecting along the front end of said rear upper portion when said tongues are in said grooves, said projecting part being received in a socket in said rear upper portion when said tongues fully engaged in said grooves, said first fastening member is attached to said projecting part, and said second fastening member engages said rear upper portion adjacent the rear end of said rear upper portion and extends longitudinally of said sub-assembly toward the front end of said rear upper portion.

10. A skate assembly according to claim 9, wherein said first fastening member is an internally threaded insert mounted in said projecting part, and said second fastening member is a bolt having a head bearing against and rotatable within said rear upper portion and a threaded end portion opposite said head.

11. A skate assembly according to claim 1 wherein said upper portion of said ice blade has transverse through openings and said lower portion of said frame is molded around the upper portion of said ice blade and extends through said transverse through openings.

12. A skate assembly comprising:

a boot having a front end and a sole and a heel;

front and rear attachment portions fixed respectively to said sole and heel, having front ends adjacent the front end of the boot, rear ends, and opposite side surfaces extending between said front and rear ends;

an enlongate sub-assembly including a molded polymeric frame having a front end and a rear end, said frame including a lower portion comprising transversely spaced elongate parts extending between said front and rear ends and having edge surfaces defining a bottom surface for said frame, and said frame further including spaced front and rear upper portions each having an uppermost surface opposite said bottom surface, opposite spaced side wall portions projecting from said lower portion each having inner and outer side surfaces, and front and rear ends, said side wall portions of said front upper portion diverging outwardly front said lower portion toward said uppermost surface of said front upper portion; and an ice blade including a portion mounted between said elongate parts of said lower portion and a portion projecting past said bottom surface for affording rapid movement of said skate assembly along a generally planar ice surface;

means for releaseably engaging said rear upper portion to said rear attachment portion and said front upper portion to said front attachment portion comprising, for each pair of portions to be engaged, said upper portion having opposite upper and lower surfaces and recessed surfaces defining a pair of grooves extending from an inlet adjacent one of the ends of the upper portion toward the other of the ends of the upper portion, each groove extending along a different one of the side surfaces of said upper portion, and said upper portion including ridges defining the upper surfaces of said grooves and spacing said grooves along said side wall portions from the uppermost surface of said upper portion; and said attachment portion having at least one part adapted to extend along said side surfaces of said side wall portions and including a pair of tongues having opposite upper and lower surfaces and distal surfaces extending from one of the ends of the attachment portion toward the other of the ends of the attachment portion, each tongue adapted to enter a different one of said grooves from said inlet to an engaged position with said surfaces of said grooves and tongues in frictional engagement; and fastening means comprising, for one pair of portions to be engaged, a first fastening member attached to one of said portions and a second fastening member engaging the other of said portions and adapted to releasably engage said first fastening member to releasably retain said portions with said tongues in said grooves in said engaged position.

13. A skate assembly according to claim 12 wherein said opposite upper and lower surfaces defining said grooves are tapered toward each other from said inlet, and said upper and lower surfaces of said tongues are tapered and are adapted to fully engage said upper and lower surfaces defining the grooves when said tongues are fully engaged in said grooves.

14. A skate assembly according to claim 12 wherein said attachment portions each have two spaced parts adapted to extend along the side surfaces of said side wall portions and said tongues are opposed and project toward each other from said two spaced parts generally parallel to said top surface of the attachment portion, said grooves are along the outer surfaces of said spaced side wall portions, said recessed surfaces defining said grooves are tapered away from each other from said inlet, and said tongues have tapered distal surfaces adapted to fully and frictionally engage said recessed surfaces difining the grooves when said tongues are fully engaged in said grooves.

15. A skate assembly according to claim 12 wherein the inlets to said grooves are adjacent the rear ends of said upper portions, said first fastening member is attached to said rear upper portion adjacent the front end of said rear upper portion and extends longitudinally of said sub-assembly toward the rear end of said rear upper portion, said rear attachment portion has projecting part projecting along the rear end of said rear upper portion when said tongues are in said grooves, said projecting part being received in a socket in said rear upper portion when said tongues are fully engaged in said grooves, said second fastener member is positioned within said projecting part, said first fastening member has a threaded end portion opposite the front end of said rear upper portion, and said second fastener member is an internally threaded nut rotatably mounted in said projecting part.

16. A skate assembly according to claim 16 wherein the inlets to said grooves are adjacent the front ends of said upper portions, said rear attachment member has a projecting part projecting along the front end of said rear upper portion when said tongues are in said grooves, said projecting part being received in a socket in said rear upper portion when said tongues are fully engaged in said grooves, said first fastening member is attached to said projecting part, said second fastening member engages said rear upper portion adjacent the rear end of said rear upper portion and extends longitudinally of said sub-assembly toward the front end of said rear upper portion, said first fastening member is an internally threaded insert mounted in said projecting part, and said second fastening member is a bolt having a head bearing against and rotatable within said rear upper portion and a threaded end portion opposite said head.

17. A skate assembly comprising:

front and rear attachment portions having generally planar top surfaces, front and rear ends, and opposite side surfaces extending between said front and rear ends, said attachment portions being adapted to be attached respectively to the sole and heel of a boot with said top surfaces against the bottom surfaces on the sole and heel and the front ends of the attachment portions adjacent the front end of the boot;

an elongate sub-assembly including a moded polymeric frame having a front end and a rear end, said frame including a lower portion comprising transversely spaced elongate parts extending between said front and rear ends and having edge surfaces defining a bottom surface for said frame, and said frame further including spaced front and rear upper portions each having an uppermost surface opposite said bottom surface, opposite spaced side wall portions projecting from said lower portion each having inner and outer side surfaces, and front and rear ends;

a plurality of spaced parallel axles mounted between said elongate parts of said lower portion; and a plurality of aligned rollers rotatably mounted about said axles between said elongate parts, said rollers having portions projecting past said bottom surface for affording rapid movement of said skate assembly along a generally planar surface;

means for releasably engaging said rear upper portion to said rear attachment portion and said front upper portion to said front attachment portion comprising, for each pair of portions to be engaged said upper portion having opposite upper and lower surfaces and recessed surfaces defining a pair of grooves extending from an inlet adjacent one of the ends of the upper portion toward the other of the ends of the upper portion, each groove extending along a different one of the side surfaces of said upper portion, and said upper portion including ridges defining the upper surfaces of said grooves and spacing said grooves from along said side wall portions from the uppermost surface of said upper portion; and said attachment portion having at least one part adapted to extend along said side surfaces of said side wall portions and including a pair of tongues having opposite upper and lower surfaces and distal surfaces extending from one of the ends of the attachment portion toward the other of the ends of the attachment portion, each tongue adapted to enter a different one of said grooves from said inlet to an engaged position with said surfaces of said grooves and tongues in frictional engagement; and fastening means comprising, for one pair of attachment and upper portions to be engaged, a first fastening member engaging one of said portions in said one pair and a second fastening member engaging the other of said portions in said one pair and adapted to releasably engage said first fastening member to releasably retain said attachment and upper portions with said tongues in said grooves in said engaged position, said attachment portion in said one pair has a projecting part projecting along the end of said upper portion in said one pair adjacent the inlets to said grooves when said tongues are in said grooves, one of said fastening members engages said projecting part, and the other of said fastening members engages said upper portion in said one pair and extends longitudinally of said sub-assembly toward the end of said upper portion in said one pair adjacent the inlets to said grooves.

18. A skate assembly according to claim 17 wherein each of said attachment portions comprises a top plate part having said top surface, an opposite lower surface, and a peripheral edge surface between said top and lower surfaces, said tongues project in opposite directions generally parallel to and spaced from said lower surface of said top plate part, said lower surface of said top plate part extends beyond all portions of said tongues, and said grooves are along the inner surfaces of said spaced side wall portions.

19. A skate assembly according to claim 17 wherein said opposite upper and lower surfaces defining said grooves are tapered toward each other from said inlet and said upper and lower surfaces of said tongues are tapered and are adapted to fully engage said upper and lower surfaces defining the grooves when said tongues are fully engaged in said grooves.

20. A skate assembly according to claim 17 wherein the opposite upper and lower surfaces defining said grooves and the opposite upper and lower surfaces of said tongues are disposed to form dovetail transverse cross sections for said grooves and said tongues.

21. A skate assembly according to claim 17 wherein said attachment portions each have two spaced parts adapted to extend along the side surfaces of said side wall portions and said tongues are opposed and project toward each other from said two spaced parts generally parallel to said top surface of the attachment portion, and said grooves are along the outer surfaces of said spaced side wall portions.

22. A skate assembly according to claim 21 wherein said recessed surfaces defining said grooves are tapered away from each other from said inlet and said distal surfaces of said tongues are tapered and are adapted to fully and frictionally engage said recessed surfaces defining the grooves when said tongues are fully engaged in said grooves.

23. A skate assembly according to claim 17 wherein the inlets to said grooves are adjacent the rear ends of said upper portions, said first fastening member is attached to said rear upper portion adjacent the front end of said rear upper portion and extends longitudinally of said sub-assembly toward the rear end of said rear upper portion, said rear attachment portion has said projecting part and projecting part projects along the rear end of said rear upper portion when said tongues are in said grooves, said projecting part being received in a socket in said rear upper portion when said tongues are fully engaged in said grooves, and said second fastener member is positioned within said projecting part.

24. A skate assembly according to claim 23 wherein said first fastening member has a threaded end portion opposite the front end of said rear upper portion, and said second fastener member is an internally threaded nut rotatably mounted within said projecting part adapted to threadably engage said threaded end portion.

25. A skate assembly according to claim 17 wherein the inlets to said grooves are adjacent the front ends of said upper portions, said rear attachment member has said projecting part and said projecting part projects along the front end of said rear upper portion when said tongues are in said grooves, said projecting part being received in a socket in said rear upper portion when said tongues are fully engaged in said grooves, said first fastening member is attached to said projecting part, and said second fastening member engages said rear upper portion adjacent the rear end of said rear upper portion and extends longitudinally of said sub-assembly toward the front end of said rear upper portion.

26. A skate assembly according to claim 25 wherein said first fastening member is an internally threaded insert fixedly mounted within said projecting part, and said second fastening member is a bolt having a head bearing against and rotatable within said rear upper portion and a threaded end portion opposite said head adapted to threadably engage said insert.

27. A skate assembly comprising:

a boot having a front end and a sole and a heel;

front and rear attachment portions fixed respectively to said sole and heel, having front ends adjacent the front end of the boot, rear ends, and opposite side surfaces extending between said front and rear ends;

an elongate sub-assembly including a molded polymeric frame having a front end and a rear end, said frame including a lower portion comprising transversely spaced elongate parts extending between said front and rear ends and having edge surfaces defining a bottom surface for said frame, and said frame further including spaced front and rear upper portions each having an uppermost surface opposite said bottom surface, opposite spaced side wall portions projecting from said lower portion each having inner and outer side surfaces, and front and rear ends;

a plurality of spaced parallel axles mounted between said elongate parts of said lower portion; and a plurality of aligned rollers rotatably mounted about said axles between said elongate parts, said rollers having portions projecting past said bottom surface for affording rapid movement of said skate assembly along a generally planar surface;

means for releasably engaging said rear upper portion to said rear attachment portion and said front upper portion to said front attachment portion comprising, for each pair of portions to be engaged, said upper portion having opposite upper and lower surfaces and recessed surfaces defining a pair of grooves extending from an inlet adjacent one of the ends of the upper portion toward the other of the ends of the upper portion, each groove extending along a different one of the side surfaces of said upper portion, and said upper portion including ridges defining the upper surfaces of said grooves and spacing said grooves from along said side wall portions from the uppermost surface of said upper portion; and said attachment portion having at least one part adapted to extend along said side surfaces of said side wall portions and including a pair of tongues having opposite upper and lower surfaces and distal surfaces extending from one of the ends of the attachment portion toward the other of the ends of the attachment portion, each tongue adapted to enter a different one of said grooves from said inlet to an engaged position with said surfaces of said grooves and tongues in frictional engagement; and fastening means comprising, for one pair of attachment and upper portions to be engaged, a first fastening member engaging one of said portions in said one pair and a second fastening member engaging the other of said portions in said one pair and adapted to releasably engage said first fastening member to releasably retain said attachment and upper portions with said tongues in said grooves in said engaged position, said attachment portion in said one pair has a projecting part projecting along the end of said upper portion in said one pair adjacent the inlets to said grooves when said tongues are in said grooves, one of said fastening members engages said projecting part, and the other of said fastening members engages said upper portion in said one pair and extends longitudinally of said sub-assembly toward the end of said upper portion in said one pair adjacent the inlets to said grooves.

28. A skate assembly according to claim 27 wherein said opposite upper and lower surfaces defining said grooves are tapered toward each other from said inlet, and said upper and lower surfaces of said tongues are tapered and are adapted to fully engage said upper and lower surfaces defining the grooves when said tongues are fully engaged in said grooves.

29. A skate assembly according to claim 27 wherein the opposite upper and lower surfaces defining said grooves and the opposite upper and lower surfaces of said tongues are disposed to form dovetail transverse cross sections for said grooves and said tongues.

30. A skate assembly according to claim 27 wherein said attachment portions each have two spaced parts adapted to extend along the side surfaces of said side wall portions and said tongues are opposed and project toward each other from said two spaced parts generally parallel to said top surface of the attachment portion, said grooves are along the outer surfaces of said spaced side wall portions, said recessed surfaces defining said grooves are tapered away from each other from said inlet, and said distal surfaces of said tongues are tapered and are adapted to fully and frictionally engage said recessed surfaces defining the grooves when said tongues are fully engaged in said grooves.

31. A skate assembly according to claim 27 wherein the inlets to said grooves are adjacent the rear ends of said upper portions, said first fastening member is attached to said rear upper portion adjacent the front end of said rear upper portion and extends longitudinally of said sub-assembly toward the rear end of said rear upper portion, said rear attachment portion has said projecting part and said projecting part projects along the rear end of said rear upper portion when said tongues are in said grooves, said projecting part being received in a socket in said rear upper portion when said tongues are fully engaged in said grooves, and said second fastener member is positioned within said projecting part.

32. A skate assembly according to claim 27 wherein the inlets to said grooves are adjacent the front ends of said upper portions, said rear attachment member has said projecting part and said projecting part projects along the front end of said rear upper portion when said tongues are in said grooves, said projecting part being received in a socket in said rear upper protion when said tongues are fully engaged in said grooves, said first fastening member is attached to said projecting part, and said second fastening member engages said rear upper portion adjacent the rear end of said rear upper portion and extends longitudinally of said sub-assembly toward the front end of said rear upper portion.

33. A skate assembly comprising:

front and rear attachment portions having generally planar top surfaces, front and rear ends, and opposite side surfaces extending between said front and rear ends, said attachment portions being adapted to be attached respectively to the sole and heel of a boot with said top surfaces against the bottom surfaces on the sole and heel and the front ends of the attachment portions adjacent the front end of the boot;

an elongate sub-assembly including a molded polymeric frame having a front end, a rear end, a lower portion having a bottom surface, and spaced front and rear upper portions each having an uppermost surface opposite said bottom surface, opposite spaced side wall portions projecting from said lower portion each having inner and outer side surfaces, and front and rear ends; and means mounted along said lower portion and projecting past said bottom surface for affording rapid movement of said skate assembly along a generally planar substrate;

means for releasably engaging said rear upper portion to said rear attachment portion and said front upper portion to said front attachment portion comprising, for each pair of portions to be engaged, one of said portions having opposite upper and lower surfaces and recessed surfaces defining a pair of grooves extending from an inlet adjacent one of the ends of said one portion toward the other of the ends of said one portion, eahc groove extends along a different one of the side surfaces of said one portion; and the other of said portions having a pair of tongues having opposite upper and lower surfaces and distal surfaces extending from one of the ends of said other portion toward the other of the ends of said other portion, each tongue extending along a different one of the side surfaces of said other portion and adapted to enter a different one of said grooves from said inlet to an engaged position with said surfaces of said grooves and tongues in frictional engagement; and fastening means comprising, for one pair of portions to be engaged, a first fastening member attached to one of said portions and a second fastening member engaging the other of said portions and adapted to releasably engage said first fastening member to releasably retain said portions with said tongues in said grooves in said engaged position;

the inlets to said grooves are adjacent the front ends of said upper portions;

said rear attachment member has a projecting part projecting along the front end of said rear upper portion when said tongues are in said grooves, said projecting part being received in a socket in said rear upper portion when said tongues are fully engaged in said grooves, said first fastening member is attached to said projecting part, and said second fastening member engages said rear upper portion adjacent the rear end of said rear upper portion and extends longitudinally of said sub-assembly toward the front end of said rear upper portion.

34. A skate assembly according to claim 33 wherein said first fastening member is an internally threaded insert mounted in said projecting part, and said second fastening member is a bolt having a head bearing against and rotatable within said rear upper portion and a threaded end portion opposite said head.

35. A skate assembly comprising:

a boot having a front end and a sole and a heel;

front and rear attachment portions fixed respectively to said sole and heel, having front ends adjacent the front end of the boot, rear ends, and opposite side surfaces extending between said front and rear ends;

an elongate sub-assembly including a molded polymeric frame having a front end, a rear end, a lower portion having a bottom surface, and spaced front and rear upper portions each having an uppermost surface opposite said bottom surface, opposite spaced side wall portions projecting from said lower portion each having inner and outer side surfaces, and front and rear end; and means mounted along said lower portion and projecting past said bottom surface for affording rapid movement of said skate assembly along a generally planar substrate;

means for releasably engaging said rear upper portion to said rear attachment portion and said front upper portion to said front attachment portion comprising, for each pair of portions to be engaged, one of said portions having opposite upper and lower surfaces and recessed surfaces defining a pair of grooves extending from an inlet adjacent one of the ends of said one portion toward the other of the ends of said one portion, each groove extends along a different one of the side surfaces of said one portion; and the other of said portions having a pair of tongues having opposite upper and lower surfaces and distal surfaces extending from one of the ends of said other portion toward the other of the ends of said other portion, each tongue extending along a different one of the side surfaces of said other portion and adapted to enter a different one of said grooves from said inlet to an engaged position with said surfaces of said grooves and tongues in frictional engagement; and fastening means comprising, for one pair of portions to be engaged, a first fastening member attached to one of said portions and a second fastening member engaging the other of said portions and adapted to releasably engage said first fastening member to releasably retain said portions with said tongues in said grooves in said engaged position;

the inlets to said grooves are adjacent the front ends of said upper portions;

said rear attachment member has a projecting part projecting along the front end of said rear upper portion when said tongues are in said grooves, said projecting part being received in a socket in said rear upper portion when said tongues are fully engaged in said grooves, said first fastening member is attached to said projecting part, said second fastening member engages said rear upper portion adjacent the rear end of said rear upper portion and extends longitudinally of said sub-assembly toward the front end of said rear upper portion, said first fastening member is an internally threaded insert mounted in said projecting part, and said second fastening member is a bolt having a head bearing against and rotatable within said rear upper portion and a threaded end portion opposite said head.

36. A skate assembly comprising:

a boot having a front end and a sole and a heel;

front and rear attachment portions fixed respectively to said sole and heel, having front ends adjacent the front end of the boot, rear ends, and opposite side surfaces extending between said front and rear ends;

an elongate sub-assembly including a molded polymeric frame having a front end, a rear end, a lower portion having a bottom surface, and spaced front and rear upper portions each having an uppermost surface opposite said bottom surface, opposite spaced side wall portions porjecting from said lower portion each having inner and outer side surfaces, and front and rear ends; and means mounted along said lower portion and projecting past said bottom surface for affording rapid movement of said skate assembly along a generally planar substrate;

means for releasably engaging said rear upper portion to said rear attachment portion and said front upper portion to said front attachment portion comprising, for each pair of portions to be engaged, one of said portions having opposite upper and lower surfaces and recessed surfaces defining a pair of grooves extending from an inlet adjacent on of the ends of said one portion toward the other of the ends of said one portion, each groove extends along a different one of the side surfaces of said one portion; and the other of said portions having a pair of tongues having opposite upper and lower surfaces and distal surfaces extending from one of the ends of said other portion toward the other of the ends of said other portion, each tongue extending along a different one of the side surfaces of said other portion and adapted to enter a different one of said grooves from said inlet to an engaged position with said surfaces of said grooves and tongues in frictional engagement; and fastening means comprising, for one pair of portions to be engaged, a first fastening member attached to one of said portions and a second fastening member engaging the other of said portions and adapted to releasably engage said first fastening member to releasably retain said portions with said tongues in said grooves in said engaged position;

the inlets to said grooves are adjacent the rear ends of said upper portions;

said first fastening member is attached to said rear upper portion adjacent the front end of said rear upper portion and extends longitudinally of said sub-assembly toward the rear end of rear upper portion, said rear attachment portion has a projecting part projecting along the rear end of said rear upper portion when said tongues are in said grooves, said projecting part being received in a socket in said rear upper portion when said tongues are fully engaged in said grooves, said second fastener member is positioned within said projecting part, said first fastening member has a threaded end portion opposite the front end of said rear upper portion, and said second fastener member is and internally threaded nut rotatably mounted in said projecting part.

37. A skate assembly comprising:

front and rear attachment portions having generally planar top surfaces, front and rear ends, and opposite side surfaces extending between said front and rear ends, said attachment portions being adapted to be attached repectively to the sole and heel of a boot with said top surfaces against the bottom surfaces on the sole and heel and the front ends of the attachment portions adjacent the front end of the boot;

an elongate sub-assembly including a molded polymeric frame having a front end, a rear end, a lower portion having a bottom surface, and spaced front and rear upper portions each having an uppermost surface opposite said bottom surface, opposite spaced side wall portions projecting from said lower portion each having inner and outer side surfaces, and front and rear ends; and means mounted along said lower portion and projecting past said bottom surface for affording rapid movement of said skate assembly along a generally planar substrate;

means for releasably engaging said rear upper portion to said rear attachment portion and said front upper portion to said front attachment portion comprising, for each pair of portions to be engaged, one of said portions having opposite upper and lower surfaces and recessed surfaces defining a pair of grooves extending from an inlet adjacent one of the ends of said one portion toward the other of the ends of said one portion, each groove extends along a different one of the side surfaces of said one portion; and the other of said portions having a pair of tongues having opposite upper and lower surfaces and distal surfaces extending from one of the ends of said other portion toward the other of the ends of said other portion, each tongue extending along a different one of the side surfaces of said other portion and adapted to enter a different one of said grooves from said inlet to an engaged position with said surfaces of said grooves and tongues in frictional engagement; and fastening means comprising, for one pair of portions to be engaged, a first fastening member attached to one of said portions and a second fastening member engaging the other of said portions and adapted to releasably engage said first fastening member to releasably retain said portions with said tongues in said grooves in said engaged position;

the inlets to said grooves are adjacent the rear ends of said upper portions;

said first fastening member is attached to said rear upper portion adjacent the front end of said rear upper portion and extends longitudinally of said sub-assembly toward the rear end of rear upper portion, said rear attachment portion has a projecting part projecting along the rear end of said rear upper portion when said tongues are in said grooves, said projecting part being received in a socket in said rear upper portion when said tongues are fully engaged in said grooves, said second fastener member is positioned within said projecting part, said first fastening member has a threaded end portion opposite the front end of said rear upper portion, and said second fastener member is an internally threaded nut rotatably mounted in said projecting part.

38. A skate assembly comprising:

front and rear attachment portions having generally planar top surfaces, front and rear ends, and opposite side surfaces extending between said front and rear ends, said attachment portions being adapted to be attached respectively to the sole and heel of a boot with said top surfaces against the bottom surfaces on the sole and heel and the front ends of the attachment portions adjacent the front end of the boot;

an elongate sub-assembly including a molded polymeric frame having a front end and a rear end, said frame including a lower portion comprising transversely spaced elongate parts extending between said front and rear ends and having edge surfaces defining a bottom surface for said frame, and said frame further including spaced front and rear upper portions each having an uppermost surface opposite said bottom surface, wall portions projecting from said lower portion having side surfaces, and front and rear ends, said wall portions of said front upper portion diverging outwardly from said lower portion toward said uppermost surface; and an ice blade including a portion mounted between said elongate parts of said lower portion and a portion projecting past said bottom surface for affording rapid movement of said skate assembly along a generally planar ice surface;

means for releasably engaging said rear upper portion to said rear attachment portion and said front upper portion to said front attachment portion comprising, for each pair of portions to be engaged said upper portion having opposite upper and lower surfaces and recessed surfaces defining a pair of grooves extending from an inlet adjacent one of the ends of the upper portion toward the other of the the ends of the upper portion, each groove extending along a different one of the side surfaces of said upper portion, and said upper portion including ridges defining the upper surfaces of said grooves and spacing said grooves from along said side wall portions from the uppermost surface of said upper portion; and said attachment portion having at least one part adapted to extend along said side surfaces of said side wall portions and including a pair of tongues having opposite upper and lower surfaces and distal surfaces extending from one of the ends of the attachment portion toward the other of the ends of the attachment portion, each tongue adapted to enter a different one of said grooves from said inlet to an engaged position with said surfaces of said grooves and tongues in frictional engagement; and fastening means comprising, for one pair of portions to be engaged, a first fastening member attached to one of said portions and a second fastening member engaging the other of said portions and adapted to releasably engage said first fastening member to releasable retain said portions with said tongues in said grooves in said engaged position.

39. A skate assembly comprising:

a boot having a front end and a sole and a heel;

front and rear attachment portions fixed respectively to said sole and heel, having front ends adjacent the front end of the boot, rear ends, and opposite side surfaces extending between said front and rear ends;

an elongate sub-assembly including a molded polymeric frame having a front end and a rear end, said frame including a lower portion comprising transversely spaced elongate parts extending between said front and rear ends and having edge surfaces defining a bottom surface for said frame, and said frame further including spaced front and rear upper portions each having an uppermost surface opposite said bottom surface, side wall portions projecting from said lower portion having side surfaces, and front and rear ends, said side wall portions of said front upper portion diverging outwardly from said lower portion toward said uppermost surface; and an ice blade including a portion mounted between said elongate parts of said lower portion and a portion projecting past said bottom surface for affording rapid movement of said skate assembly along a generally planar ice surface;

means for releasably engaging said rear upper portin to said rear attachment portion and said front upper portion to said front attachment portion comprising, for each pair of portions to be engaged said upper portion having opposite upper and lower surfaces and recessed surfaces defining a pair of grooves extending from an inlet adjacent one of the ends of the upper portion toward the other of the ends of the upper portion, each groove extending along a different one of the side surfaces of said upper portion, and said upper portion including ridges defining the upper surfaces of said grooves and spacing said grooves from along said side wall portions from the uppermost surface of said upper portion; and said attachment portion having at least one part adapted to extend along said side surfaces of said side wall portions and including a pair of tongues having opposite upper and lower surfaces and distal surfaces extending from one of the ends of the attachment portion toward the other of the ends of the attachment portion, each tongue adapted to enter a different one of said grooves from said inlet to an engaged position with said surfaces of said grooves and tongues in frictional engagement; and fastening means comprising, for one pair of portions to be engaged, a first fastening member attached to one of said portions and a second fastening member engaging the other of said portions and adapted to releasably engage said first fastening member to releasably retain said portions with said tongues in said grooves in said engaged position.

40. A skate assembly comprising:

front and rear attachment portions having generally planar top surfaces, front and rear ends, and opposite side surfaces extending between said front and rear ends, said attachment portions being adapted to be attached respectively to the sole and heel of a boot with said top surfaces against the bottom surfaces on the sole and heel and the front ends of the attachment portions adjacent the front end of the boot;

an elongate sub-assembly including a molded polymeric frame having a front end and a rear end, said frame including a lower portion comprising transversely spaced elongate parts extending between said front and rear ends and having edge surfaces defining a bottom surface for said frame, and said frame further including spaced front and rear upper portions each having an uppermost surface opposite said bottom surface, side wall portions projecting from said lower portion having side surfaces, and front and rear ends;

a plurality of spaced parallel axles mounted between said elongate parts of said lower portion; and a plurality of aligned rollers rotatably mounted about said axles between said alongate parts, said rollers having portions projecting past said bottom surface for affording rapid movement of said skate assembly along a generally planar surface;

means for releasably engaging said rear upper portion to said rear atachment portion and said front upper portion to said front attachment portion comprising, for each pair of portions to be engaged said upper portion having opposite upper and lower surfaces and recessed surfaces defining a pair of grooves extending from an inlet adjacent one of the ends of the upper portion toward the other of the ends of the upper portion, each groove extending along a different one of the side surfaces of said upper portion, and said upper portion including ridges defining the upper surfaces of said grooves and spacing said grooves from along said side wall portions from the uppermost surface of said upper portion; and said attachment portion having at least one part adapted to extend along said side surfaces of said side wall portions and including a pair of tongues having opposite upper and lower surfaces and distal surfaces extending from one of the ends of the attachment portion toward the other of the ends of the attachment portion, each tongue adapted to enter a different one of said grooves from said inlet to an engaged position with said surfaces of said grooves and tongues in frictional engagement; and fastening means comprising, for one pair of attachment and upper portions to be engaged, a first fastening member engaging one of said portions in said one pair and a second fastening member engaging the other of said portions in said one pair and adapted to releasably engage said first fastening member to releasably retain said attachment and upper portions with said tongues in said grooves in said engaged position, said attachment portion in said one pair has a projecting part projecting along the end of said upper portion in said one pair adjacent the inlets to said grooves when said tongues are in said grooves, one of said fastening members engages said projecting part, and the other of said fastening members engages said upper portion in said one pair and extends longitudinally of said sub-assembly toward the end of said upper portion in said one pair adjacent the inlets to said grooves.

41. A skate assembly comprising:

a boot having a front end and a sole and a heel;

front and rear attachment portions fixed respectively to said sole and heel, having front ends adjacent the front end of the boot, rear ends, and opposite side surfaces extending between said front and rear ends;

an elongate sub-assembly including a molded polymeric frame having a front end and a rear end, said frame including a lower portion comprising transversely spaced elongate parts extending between said front and rear ends and having edge surfaces defining a bottom surface for said frame, and said frame further including spaced front and rear upper portions each having an uppermost surface opposite said bottom surface, wall portions projecting from said lower portion having side surfaces, and front and rear ends;

a plurality of spaced parallel axles mounted between said elongate parts of said lower portion; and a plurality of aligned rollers rotatably mounted about said axles between said elongate parts, said rollers having portions projecting past said bottom surface for affording rapid movement of said skate assembly along a generally planar surface;

means for releasably engaging said rear upper portion to said rear attachment portion and said front upper portion to said front attachment portion comprising, for each pair of portions to be engaged said upper portion having opposite upper and lower surfaces and recessed surfaces defining a pair of grooves extending from an inlet adjacent one of the ends of the upper portion toward the other of the ends of the upper portion, each groove extending along a different one of the side surfaces of said upper portion, and said upper portion including ridges defining the upper surfaces of said grooves and spacing said grooves from along said side wall portions from the uppermost surface of said upper portion; and said attachment portion having at least one part adapted to extend along said side surfaces of said side wall portions and including a pair of tongues having opposite upper and lower surfaces and distal surfaces extending from one of the ends of the attachment portion toward the other of the ends of the attachment portion, each tongue adapted to enter a different one of said grooves from said inlet to an engaged position with said surfaces of said grooves and tongues in frictional engagement; and fastening means comprising, for one pair of attachment and upper portions to be engaged, a first fastening member engaging one of said portions in said one pair and a second fastening member engaging the other of said portions in said one pair and adapted to releasably engage said first fastening member to releasably retain said attachment and upper portions with said tongues in said grooves in said engaged position, said attachment portion in said one pair has a projecting part projecting along the end of said upper portion in said one pair adjecent the inlets to said grooves when said tongues are in said grooves, one of said fastening members engages said projecting part, and the other of said fastening members engages said upper portion in said one pair and extends longitudinally of said sub-assembly toward the end of said upper portion in said one pair adjacent the inlets to said grooves.

* * * * *